US011850816B2

(12) United States Patent
Bro et al.

(10) Patent No.: US 11,850,816 B2
(45) Date of Patent: Dec. 26, 2023

(54) ARBOR PRESS WITH LIMITER CONTROLLING RAM LOAD AND TRAVEL

(71) Applicant: Raytheon Company, Waltham, MA (US)

(72) Inventors: Mitchell Bro, Tucson, AZ (US); John Tristan Elmer, Tucson, AZ (US); Jarrod Salmon, Tucson, AZ (US); William Straus, Tucson, AZ (US)

(73) Assignee: Raytheon Company, Tewksbury, MA (US)

( * ) Notice: Subject to any disclaimer, the term of this patent is extended or adjusted under 35 U.S.C. 154(b) by 79 days.

(21) Appl. No.: 17/464,818

(22) Filed: Sep. 2, 2021

(65) Prior Publication Data

US 2023/0064216 A1 Mar. 2, 2023

(51) Int. Cl.
*B30B 1/04* (2006.01)
*B30B 15/06* (2006.01)

(52) U.S. Cl.
CPC ..... *B30B 1/04* (2013.01); *B30B 15/065* (2013.01)

(58) Field of Classification Search
CPC .... B30B 1/04; B30B 1/12; B30B 1/20; B30B 1/24; B30B 1/326; B30B 15/065; Y10T 29/51
USPC ..... 100/214; 29/251
See application file for complete search history.

(56) References Cited

U.S. PATENT DOCUMENTS 3,686,922 A * 8/1972 Bley ..... B30B 1/24 100/231
4,473,932 A * 10/1984 Widner ..... F42B 33/06 29/251
5,519,928 A * 5/1996 Hardy ..... A61C 1/00 29/251

OTHER PUBLICATIONS

Cleanroom Arbor Press (https://www.janesvilletool.com/PressUses/CleanRoom) from (https://web.archive.org/web/20210730141257/https://www.janesvilletool.com/PressUses/CleanRoom) site accessed Nov. 17, 2022 (Year: 2021).*

* cited by examiner

*Primary Examiner* — Adam J Eiseman
*Assistant Examiner* — Fred C Hammers
(74) *Attorney, Agent, or Firm* — Renner, Otto, Boisselle & Sklar, LLP

(57) ABSTRACT

An arbor press includes a limiter for limiting load and/or travel of a ram used to press on an object. The ram includes a pair of pieces, a shaft and a sleeve, which are capable of relative translation, modulated by the spring. The spring may be preloaded, and configured to prevent overloading of the object, by limiting the transmission of force through the ram. The ram may also be configured to limit travel of the ram. The arbor press may include gearing to translate rotational movement of a handle to translational movement of the ram. The gearing may include a rack that is part of or is coupled to the shaft, and a pinion that is connected to the handle. Parts of the arbor press may be enclosed in a housing, to contain debris from metal-to-metal sliding in the arbor press, facilitating use in clean rooms.

18 Claims, 2 Drawing Sheets

ARBOR PRESS WITH LIMITER CONTROLLING RAM LOAD AND TRAVEL

GOVERNMENT RIGHTS

This invention was made with government support under government contract HQ0276-15-C-0003 awarded by the United States Missile Defense Agency. The government has certain rights in the invention.

FIELD

The present disclosure is in the field of devices and methods for pressing on objects, such as arbor presses.

BACKGROUND

Hand tools have been used to provide compression for assembly of devices and structures, for example in providing compression to spring-loaded fastener parts. There is a risk of such tools slipping off the parts to be compressed, which can cause damage and/or produce metal particles, which is undesirable in certain environments, such as clean rooms. In addition hand tools may provide a compression force that is difficult to modulate.

SUMMARY

An arbor press provides repeatable and moderated compression force, while also allowing for containment of particles produced by movement of parts of the arbor press.

An arbor press includes a ram, and a limiter that limits force through and/or limits travel of the ram.

An arbor press includes a housing that contains debris produced by metal-metal sliding involved in operation of the arbor press.

According to an aspect of the disclosure, an arbor press includes: a ram that includes: a sleeve; a shaft movable within the sleeve; and a spring coupled to the shaft and the sleeve to limit load transmitted through the ram; and a handle operatively coupled to the ram, to translate the ram.

According to an embodiment of any paragraph(s) of this summary, the handle is rotated to translate the ram.

According to an embodiment of any paragraph(s) of this summary, the handle rotates to move the ram in a direction toward or away from an object.

According to an embodiment of any paragraph(s) of this summary, the handle has a counterweight on a short side of the handle.

According to an embodiment of any paragraph(s) of this summary, the press further includes gearing coupling the handle to the ram.

According to an embodiment of any paragraph(s) of this summary, the gearing includes a rack attached to the shaft, and a pinion mechanically coupled to the handle, where the pinion engages the rack.

According to an embodiment of any paragraph(s) of this summary, the spring is a coil spring.

According to an embodiment of any paragraph(s) of this summary, the spring is inside the sleeve.

According to an embodiment of any paragraph(s) of this summary, the spring presses against an end of the sleeve and an end of the shaft.

According to an embodiment of any paragraph(s) of this summary, the spring is preloaded, preventing overloading by the ram.

According to an embodiment of any paragraph(s) of this summary, the press further includes a pin that is coupled to the shaft, with the pin protruding from the shaft to engage a slotted hole in the sleeve.

According to an embodiment of any paragraph(s) of this summary, the press further includes a housing that encloses part of the ram.

According to an embodiment of any paragraph(s) of this summary, all debris from metal-to-metal sliding contacts of the arbor press is contained by the housing.

According to an embodiment of any paragraph(s) of this summary, the press further includes an interface tip coupled to the ram, for applying to an object force transmitted through the ram.

According to an embodiment of any paragraph(s) of this summary, the press further includes a bearing between interface tip and outer end of sleeve.

According to an embodiment of any paragraph(s) of this summary, the press further includes a spring plunger lock for selectively locking the ram in an extended position.

According to an embodiment of any paragraph(s) of this summary, the spring plunger engages the ram inside of a housing of the arbor press.

According to an embodiment of any paragraph(s) of this summary, the press is part of a fixture that is configured to receive an object while the ram presses on the object.

According to another aspect of the disclosure, a method of operating an arbor press includes the steps of: rotating a handle to extend a ram of the arbor press; and using a limiter of the arbor press to force through and/or travel of the ram.

According to yet another aspect of the disclosure, a method of operating an arbor press includes the steps of: rotating a handle to extend a ram of the arbor press; and containing, using a housing of the arbor press, metal particles produced by metal-metal sliding cause by the rotating the handle to extend the ram.

While a number of features are described herein with respect to embodiments of the disclosure; features described with respect to a given embodiment also may be employed in connection with other embodiments. The following description and the annexed drawings set forth certain illustrative embodiments of the disclosure. These embodiments are indicative, however, of but a few of the various ways in which the principles of the disclosure may be employed. Other objects, advantages, and novel features according to aspects of the disclosure will become apparent from the following detailed description when considered in conjunction with the drawings.

BRIEF DESCRIPTION OF THE DRAWINGS

The annexed drawings, which are not necessarily to scale, show various aspects of the disclosure.

DETAILED DESCRIPTION

An arbor press includes a limiter (or limiting mechanism) for limiting load and/or travel of a ram used to press on an object. The ram includes a pair of pieces, a shaft and a sleeve, which are capable of relative translation, modulated by the spring. In one embodiment the spring is a coil spring inside the sleeve, between an end of the shaft and an inner surface of the sleeve. The spring may be preloaded, and configured to prevent overloading of the object, by limiting the transmission of force through the ram. The ram may also be configured to limit travel of the ram, for example by a pin or dowel in the shaft engaging slotted holes in the sleeve, allowing the shaft to move relative to the sleeve to prevent excessive movement of the ram (outside of a predetermined travel of the ram).

The arbor press may include gearing to translate rotational movement of a handle to translational movement of the ram. The gearing may include a rack that is part of or is coupled to the shaft, and a pinion that is connected to the handle. The handle may include a counterweight to make for smoother movement. The arbor press may include a lock to lock the ram in a compressed position, the lock for example being a spring-biased plunder that engages a recess or notch in the ram.

Moving parts of the arbor press may be enclosed in a housing. This may minimize shedding of debris from metal-to-metal contacts in the arbor press, allowing use of the arbor press in clean room environs.

Figure 1:
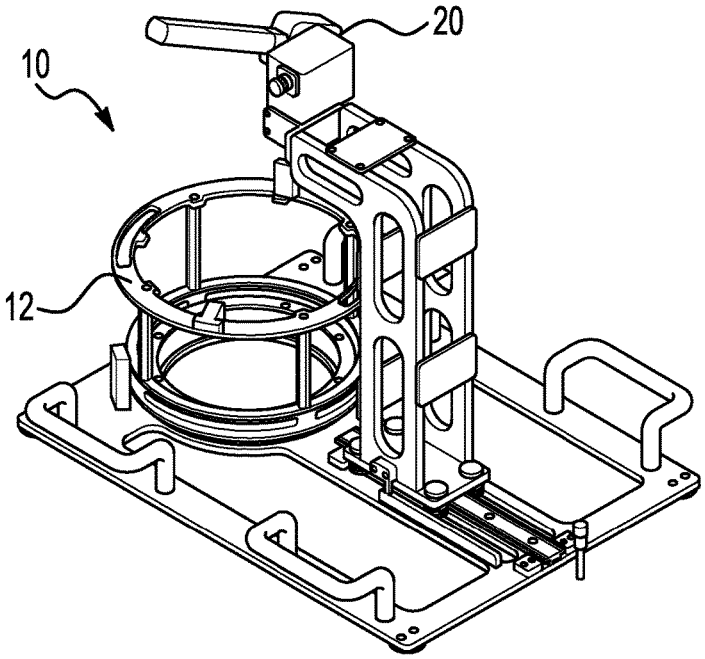
FIG. 1 is an oblique view of a fixture that includes an arbor press, according to an embodiment of the disclosure.

FIG. 1 shows a fixture 10 that is used for providing compression force for installation of hardware on an object (not shown in FIG. 1). The fixture 10 includes a mount 12 for receiving the object and holding the object in place (such as by use of clamps) for action by an arbor press 20. In an example embodiment the arbor press 20 may be used to provide a force to compress spring-loaded plungers that are part of fasteners used in assembling parts of a spacecraft. However it will be appreciated that there are many other possible uses for such a fixture, and for such an arbor press.

FIGS. 2-5 show further details of the arbor press 20. A handle 22 is used to operate the arbor press 20. The handle 22 rotates around a pivot point 24, at which a rod 26 is coupled to the handle 22, extending out from a side of the handle 22 into a housing 30. A counterweight 32 is attached to the far (short) side of the handle 22, for free release of the handle 22 back to a retracted position of the arbor press 20. A pair of bearings 33 and 34, for example stainless steel sealed ball bearings, may support the rod 26 within the housing 30. A seal 35, such as a polytetrafluoroethylene (PTFE) seal, may seal the opening where the rod 26 enters the housing 30.

The arbor press 20 includes gearing 36 for transmitting rotational motion of the handle 22 to translational motion of a ram 40 of the arbor press 20. In the illustrated embodiment the ram 40 moves in a vertical direction as the handle 22 is rotated, but alternatively the arbor press 20 may be oriented differently, to have the ram 40 translate in a different direction.

The gearing 36 includes a pinion 42 and rack 44. The pinion 42 is coupled to the rod 26 that is rotated as part of the rotation of the handle 22. Teeth of the pinion 42 mesh with those of the rack 44, such that rotation of the pinion 42 is converted to linear translation of the rack 44. The gearing 36 is inside the housing 30, so that any particles created by the metal-to-metal sliding contact between the pinion 42 and the rack 44 are not released in the environment surrounding the arbor press 20, but rather are kept within the housing 30. This facilitates use of the arbor press 20 in a clean environment, such as a clean-room environment, where particle shedding may be a concern.

The rack 44 is part of (or is operatively coupled to) the ram 40 that transmits force to the object. The ram 40 includes a shaft 52 and a sleeve 54, with a spring 56 operatively coupled to the shaft 52 and the sleeve 54. The spring 56 may be a coil spring, and modulates the travel of the ram 40, and the forces (such as compression forces) transmitted through the ram 40. The shaft 52, the sleeve 54, and the spring 56 together constitute a limiter (modulator or limiting mechanism) 57 that limits/modulates force transmitted through the ram 40 to the object, and/or travel of the ram 40.

The rack 44 may be part of the shaft 52. A distal end 58 of the shaft 52 extends through a bushing 60, into the sleeve 54. The spring 56 is located in the sleeve 54, between the shaft distal end 58 and an inner surface 64 at a bottom of a well in the sleeve 54. The spring 56 is preloaded, and is configured to prevent overloading by the ram 40, and to limit travel of the ram 40. Toward that end the shaft 52 has a pin 66 in its distal end 58. The pin 66 is perpendicular to a longitudinal axis of the shaft 52, and extends out of the diametrically opposed sides of the shaft 52 to engage slotted holes 70 and 72 in the sleeve 54. The slotted holes 70 and 72 may be bordered in part by the bushing 60. The interaction of the pin 66 and the slotted holes 70 and 72 allows limited movement of the shaft 52 relative to the sleeve 54, against a spring force from the spring 56. This prevents overloading of force from the ram 40 to the object being compressed, and prevents travel of the ram 40 too far. The slotted holes 70 and 72 may have a length of about 25 mm (1 inch)

A shaft seal 76 is used to seal the opening in the housing 30 where the ram 40 (the shaft 52) protrudes. The shaft seal 76 may be made of polytetrafluoroethylene (PTFE) or another suitable material. A retaining clip 78, such as a bendable wire or metal piece, for example made of stainless steel or another material able to flex and spring back into shape, may be used to retain the shaft seal 76 in a suitable opening in the housing 30. The use of the retaining clip 78 allows for easy assembly/disassembly, and/or replacement of the shaft seal 76, as required.

In interface tip 82 is attached to the sleeve 54 by use of a plastic cap 84 that engages a notch 86 in a distal end 88 of the sleeve 54. A bearing 90, such as a stainless steel thrust bearing, is located between the sleeve distal end 88 and an inner surface of the interface tip 82. There is a degree of float, for example a float of 1.3-2.5 mm (0.05-0.10 inches) between the interface tip 82 and the ram 40, to help center a tool on the interface tip 82 on the piece to be worked. The bearing 90 allows this float to have a rolling contact, avoiding direct metal-on-metal contact that can produce debris. The interface tip 82 may be configured to receive and secure any of a variety of suitable tools for engage a surface to be worked, such as a part of the object.

A twist-to-lock spring plunger 94 may be installed on the housing 30. The plunger 94 is able to selectively, by action of the user, engage a notch 96 in the shaft 52, to lock the ram 40 in place in its extended setting, when the ram 40 is compressing the load, such as a fastener on the object. Thus the arbor press 20 may used to apply force, then locked by the user in place in that position, for example to finish installation of the fastener.

The housing 30 may be made of a suitable metal, for example being made of electroplated stainless steel. The housing 30 encloses and contains debris produced by metal-on-metal sliding contacts. This makes the arbor press 20 suitable for use in clean environments, such as ISO Class 5 clean rooms.

Figure 2:
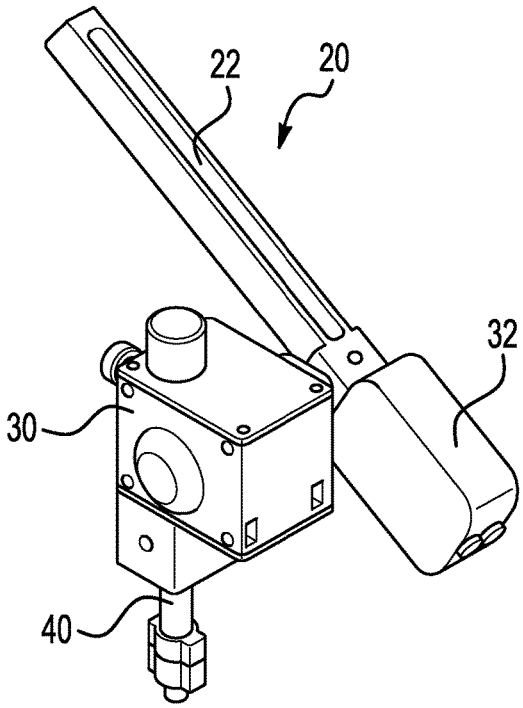
FIG. 2 is an oblique view of the arbor press of FIG. 1.
Figure 3:
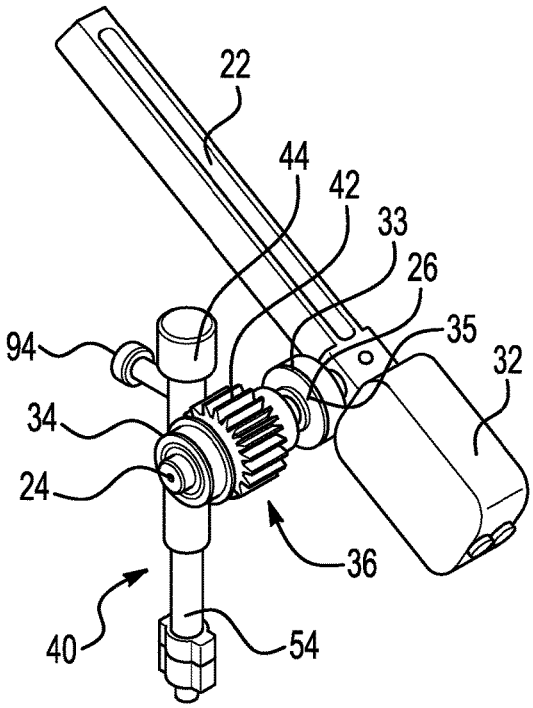
FIG. 3 is an oblique view of the arbor press of FIG. 2, with the housing removed for illustration purposes.
Figure 4:
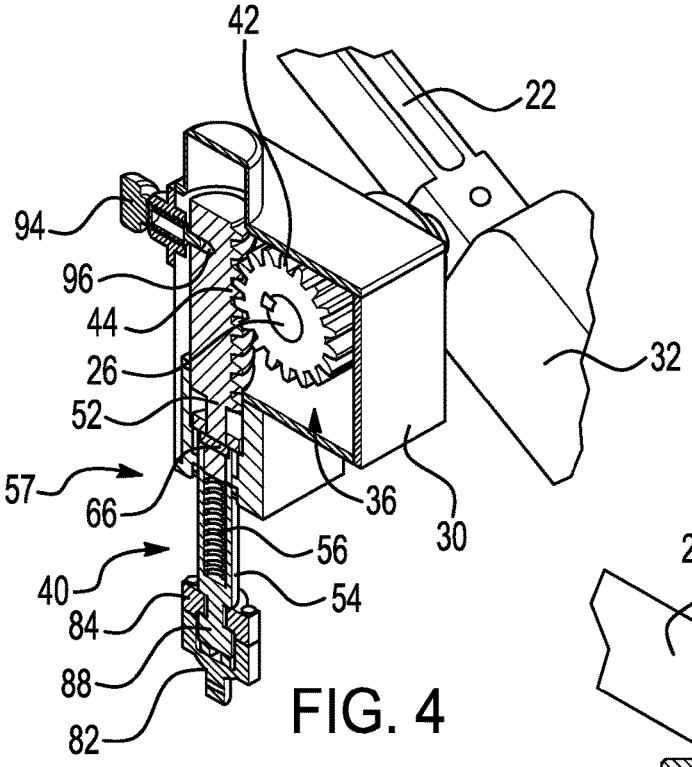
FIG. 4 is an oblique cutaway view of a portion of the arbor press of FIG. 2.
Figure 6:
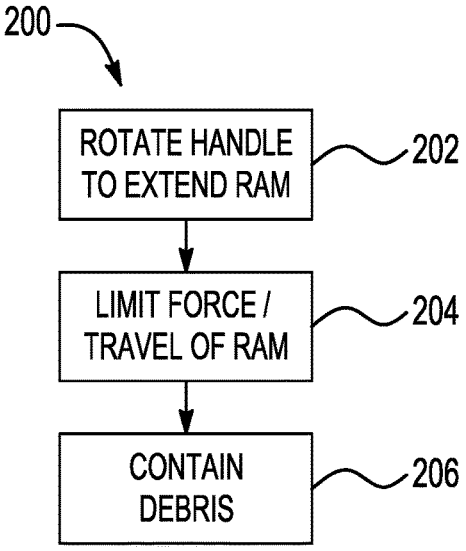
FIG. 6 is a high-level flow chart of a method of using an arbor press, according to an embodiment of the invention.
Figure 5:
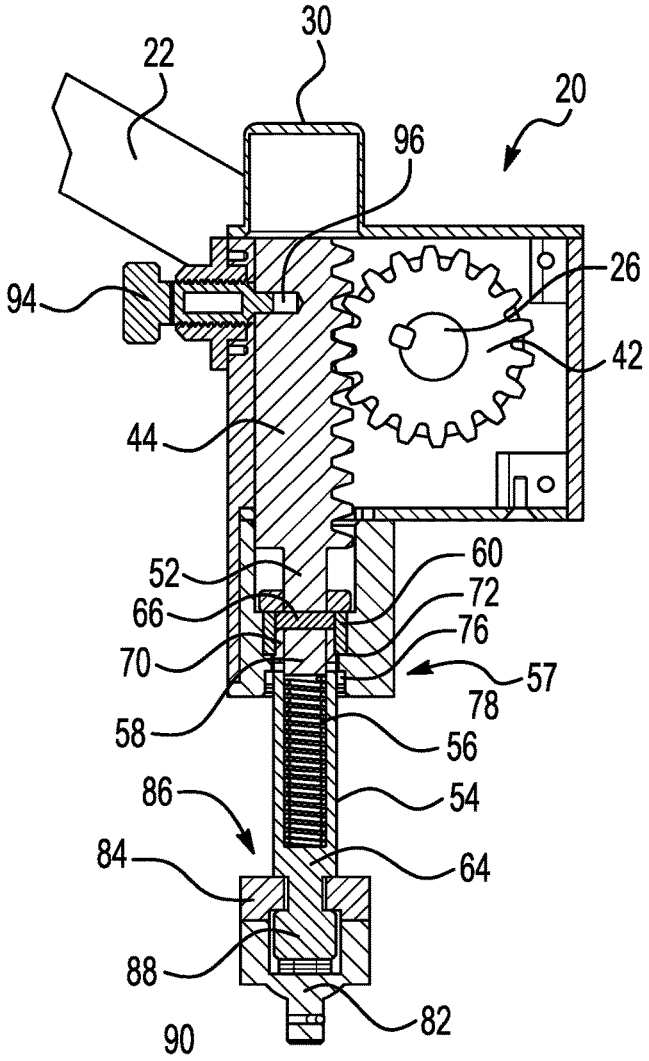
FIG. 5 is a side sectional view of a portion of the arbor press of FIG. 2.

FIG. 6 is a high-level flow chart of a method 200 of using an arbor press, such as the arbor press 20 (FIG. 1). In step 202 the handle 22 (FIG. 2) is turned, extending the ram 40 (FIG. 3) from the housing 30 (FIG. 2). In step 204 the limiter 57 (FIG. 4) limits force through and/or travel of the ram 40. In step 206, performed during operation of the arbor press 20, the housing 30 (FIG. 2) of the arbor press 20 contains debris produced by operation of the arbor press 20, such as particles produced by sliding metal-metal contacts, enabling the arbor press 20 to be used in a clean room.

Although the disclosure has been shown and described with respect to a certain embodiment or embodiments, equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the disclosure. In addition, while a particular feature of the disclosure may have been described above with respect to only one or more of several illustrated embodiments, such feature may be combined with one or more other features of the other embodiments, as may be desired and advantageous for any given or particular application.

What is claimed is:

1. An arbor press comprising:

a ram that includes:

a sleeve;

a shaft movable within the sleeve; and a spring coupled to the shaft and the sleeve to limit load transmitted through the ram;

a handle operatively coupled to the ram;

a gearing for transmitting rotational motion of the handle to translational motion of the ram, wherein the gearing includes a pinion and a rack; and a housing that completely encloses the gearing.

2. The arbor press of claim 1, wherein the handle is configured to rotate the ram in a direction toward or away from an object.

3. The arbor press of claim 1, wherein the handle has a counterweight on a short side of the handle.

4. The arbor press of claim 1, further comprising gearing coupling the handle to the ram.

5. The arbor press of claim 4, wherein the rack is attached to the shaft, and the pinion is mechanically coupled to the handle, and wherein the pinion engages the rack.

6. The arbor press of claim 1, wherein the spring is a coil spring.

7. The arbor press of claim 1, wherein the spring is inside the sleeve.

8. The arbor press of claim 7, wherein the spring presses against an end of the sleeve and an end of the shaft.

9. The arbor press of claim 1, wherein the spring is preloaded, such that the spring is configured to prevent overloading by the ram.

10. The arbor press of claim 1, further comprising a pin that is coupled to the shaft, with the pin protruding from the shaft, with the pin configured to engage a slotted hole in the sleeve.

11. The arbor press of claim 1, further comprising a housing that encloses part of the ram.

12. The arbor press of claim 11, wherein the gearing has a metal-to-metal sliding contact between the pinon and rack and any debris from the metal-to-metal sliding contacts of the arbor press is contained by the housing.

13. The arbor press of claim 1, further comprising an interface tip coupled to the ram, wherein the interface tip is configured to apply force transmitted through the ram to an object.

14. The arbor press of claim 13, further comprising a bearing between interface tip and outer end of sleeve.

15. The arbor press of claim 1, further comprising a spring plunger lock configured to selectively locking the ram in an extended position.

16. The arbor press of claim 15, wherein the spring plunger is configured to engage the ram inside of a housing of the arbor press.

17. The arbor press of claim 1, as part of a fixture that is configured to receive an object while the ram presses on the object.

18. A method of operating an arbor press, the method comprising:

rotating a handle to rotate a pinon which engages a rack to extend a ram of the arbor press; and containing, using a housing of the arbor press that encloses the pinion and the rack, metal particles produced by the pinion engaging the rack by rotating the handle to rotate the pinion which engages the rack to extend the ram.

* * * * *